US008242065B2

(12) United States Patent
Sawaguchi et al.

(10) Patent No.: US 8,242,065 B2
(45) Date of Patent: Aug. 14, 2012

(54) GREASE COMPOSITION

(75) Inventors: Wataru Sawaguchi, Ibaraki (JP); Toshio Nitta, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 328 days.

(21) Appl. No.: 12/311,666

(22) PCT Filed: Oct. 2, 2007

(86) PCT No.: PCT/JP2007/069271

§ 371 (c)(1),
(2), (4) Date: Apr. 8, 2009

(87) PCT Pub. No.: WO2008/047595

PCT Pub. Date: Apr. 24, 2008

(65) Prior Publication Data

US 2009/0270290 A1 Oct. 29, 2009

(30) Foreign Application Priority Data

Oct. 19, 2006 (JP) ..... 2006-285034

(51) Int. Cl.

| | |
|---|---|
| ***C10M 147/02*** | (2006.01) |
| ***C10M 133/20*** | (2006.01) |
| ***C10M 129/38*** | (2006.01) |
| ***C10M 137/10*** | (2006.01) |

(52) U.S. Cl. ..... 508/181; 508/539; 508/528; 508/371

(58) Field of Classification Search ..... 501/181, 501/371; 508/181, 539, 528, 371
See application file for complete search history.

(56) References Cited

U.S. PATENT DOCUMENTS

| | | | | |
|---|---|---|---|---|
| 5,512,188 | A * | 4/1996 | Kinoshita et al. | 508/137 |
| 5,672,571 | A | 9/1997 | Hatakeyama et al. | |
| 6,037,314 | A | 3/2000 | Kondo et al. | |
| 6,258,760 | B1 | 7/2001 | Ozaki et al. | |
| 2005/0075250 | A1 * | 4/2005 | MaCcone et al. | 508/182 |

FOREIGN PATENT DOCUMENTS

| | | |
|---|---|---|
| JP | 55-082196 | 6/1980 |
| JP | 62-053399 | 3/1987 |
| JP | 2000-230188 | 8/2000 |
| JP | 2001-089778 | 4/2001 |
| JP | 2002-363589 | 12/2002 |
| JP | 2005-281457 | 10/2005 |
| JP | 2006-182923 | 7/2006 |
| JP | 2007154084 A * | 6/2007 |

* cited by examiner

*Primary Examiner* — Jim Goloboy
(74) *Attorney, Agent, or Firm* — Brinks Hofer Gilson & Lione

(57) ABSTRACT

A grease composition, which comprises a base oil selected from at least one of synthetic hydrocarbon oil, ester-based synthetic oil, and ether-based synthetic oil; a thickening agent selected from at least one of lithium-based soap, lithium-based complex soap, and a urea-based compound; polytetrafluoroethylene resin powders having a number average molecular weight Mn of 20,000-100,000; and zinc dialkyldithiophosphate having straight or branched alkyl groups of at least 3 carbon atoms, preferably 5-13 carbon atoms, and more preferably 8-12 carbon atoms, has not only a distinguished lubricability, when applied to plastic members, but also a distinguished durability as given by change in friction coefficient and wear loss, after the sliding test.

6 Claims, No Drawings

GREASE COMPOSITION

RELATED APPLICATION

This application is a 35 U.S.C. §371 national stage filing of International Patent Application No. PCT/JP2007/069271, filed Sep. Oct. 2, 2007, to which priority is claimed under 35 U.S.C. §120 and through which and to which priority is claimed to Japanese Priority Patent Application No. 2006-285034, filed Oct. 19, 2006.

TECHNICAL FIELD

The present invention relates to a grease composition, and more particularly to a grease composition having distinguished lubricability and durability.

BACKGROUND ART

Grease has been so far applied to gears or sliding parts as a lubricant. Nowadays, plastic members have been more and more incorporated into automobile parts, home electrical appliances, OA devices, etc. as gears or sliding parts to attain requirements for lighter weight, lower cost, etc. The conventional grease so far used to lubricating parts of metallic members, when if applied to lubricating parts of plastic members, cannot satisfactory in respect to lower the friction coefficient or improve the durability.

A grease composition for plastic members, which comprises fine particles of polytetrafluoroethylene having an average primary particle sizes of less than 0.2 μm has been so far proposed as a grease composition having a distinguished wear resistance, capable of reducing wear of plastic members, when used under severe conditions, but still has a durability problem, even though the wear of plastic members can be suppressed by the proposed grease composition.

Patent Document 1: JP-A-2001-89778

Among the sliding parts, power transmission system parts, particularly those used in automobiles, etc. have more and more incorporated plastic members. For example, a combination of a metallic worm gears with a plastic worm wheel gears has been more and more used in the moderation mechanism. For a grease composition for lubrication of the metallic member and the plastic member as the sliding members of the power transmission system, a lubricating grease composition, which comprises, for example, a larger amount of fluororesin powders and a smaller amount of a thickening agent, has been so far proposed, but also still has a durability problem, even though the friction coefficient can be lowered in a wide temperature range by the proposed composition.

Patent Document 2: JP-A-2002-363589

DISCLOSURE OF THE INVENTION

Problem to be Solved by the Invention

The object of the present invention is to provide a grease composition having not only a distinguished lubricability, when applied to plastic members, but also a distinguished durability as given by change in friction coefficient and a wear loss, after a sliding test.

Means for Solving the Problem

The object of the present invention can be attained by a grease composition, which comprises a base oil selected from at least one of synthetic hydrocarbon oil, ester-based synthetic oil, and ether-based synthetic oil, a thickening agent selected from at least one of lithium-based soap, lithium-based complex soap, and a urea-based compound, polytetrafluoroethylene resin powders having a number average molecular weight Mn of 20,000-100,000, and zinc dialkyldithiophosphate having straight or branched alkyl groups having at least 3 carbon atoms, preferably 5-13 carbon atoms, and more preferably 8-12 carbon atoms.

Effect of the Invention

The present grease composition contains zinc dialkyldithiophosphate having alkyl groups having at least 3 carbon atoms, preferably 5-13 carbon atoms, or more preferably 2-ethylhexyl groups or octyl groups, and thus has such characteristics as not only a distinguished lubricability, even when applied to plastic members, but also a distinguished durability as given by change in friction coefficient and wear loss, after the sliding test.

The present grease composition having such characteristics can be applied to gears or sliding parts, and effectively used in lubrication of plastic members, particularly lubrication between a metallic member and a plastic member, for example, not only the sliding parts between metallic worm gears and plastic wheel gears of electrically driven power steering, but also general contact parts between a metallic part and a plastic part such as rolling contact parts of gears, sliding contact parts of worm-wheel, etc. The present grease composition can be effectively applied to similar uses of not only automobiles, but also OA devices, etc.

BEST MODES FOR CARRYING OUT THE INVENTION

The base oil for use in the present invention is at least one of synthetic hydrocarbon oil, ester-based synthetic oil, and ether-based synthetic oil, and generally has a kinematic viscosity at 40° C. of about 2 to about 1,000 $mm^2$/sec., preferably about 10 to about 500 $mm^2$/sec.

The synthetic hydrocarbon oil is not particularly limited, and includes, for example, poly-α-olefin, ethylene-α-olefin oligomers, polybutene, alkylbenzene, alkylnaphthalene, etc. The ester-based synthetic oil includes monoesters, diesters, polyol esters (complete esters such as neopentyl glycol ester, trimethylolpropane ester, pentaerythritol ester, dipentaerythritol ester, complex ester, etc.), aromatic esters, carbonate esters, etc., preferably dibasic acid esters. The dibasic acid esters are not particularly limited, and are preferably formed from $C_4$-$C_8$ fatty acids and $C_8$-$C_{20}$ alcohols. The ether-based synthetic oil includes, for example, alkyl diphenyl ether, polypropylene glycol, etc. In view of the influences on plastic members, the synthetic hydrocarbon oil is generally used, but can be used together with at least one of the ester-based synthetic oil and the ether-based synthetic oil within an uninfluenced range (for example, 0.1-30 wt. %, preferably 1-20 wt. %, and more preferably 3-10 wt. % on the basis of total composition). The range of these base oils corresponds to the balance of sum total to make 100 wt. % together with a thickening agent and the other additives.

The thickening agent for use in the present invention is at least one of lithium-based soap, lithium-based complex soap, and a urea-based compound. The lithium-based soap is Li salts of aliphatic monocarboxylic acids having 12-24 carbon atoms with or without at least one hydroxyl group. The lithium complex soap is complex salts of lithium-based soap with Ca, Al, etc., or complex salts of lithium-based soap with aliphatic dicarboxylic acids having 2-12 carbon atoms, or their esters, or with aromatic monocarboxylic acids having 7-24 carbon atoms or their esters, or with phosphate esters, borate esters, or the like. The urea-based compound is urea or a diurea compound represented by the following formula:

$$R_1NHCONHR_2NHCONHR_1$$

where $R_1$: aliphatic hydrocarbon groups of $C_6$-$C_{24}$, monovalent aromatic hydrocarbon groups of $C_6$-$C_{15}$, and $R_2$: divalent aromatic hydrocarbon groups of $C_6$-$C_{15}$, or the like.

The thickening agent can be used in a proportion of about 1 to about 40 wt. %, preferably about 3 to about 30 wt. % to make a 100 wt. % sum total together with the base oil and the other additives. When the proportion of the thickening agent is below the lower end of the range, the desired thickening effect cannot be obtained, whereas above the upper end of the range the grease composition becomes so hard that the flowability to the lubricating parts will be deteriorated.

The polytetrafluoroethylene (PTFE) resin powders for use in the ordinary lubrication usually have molecular weight of a several 100,000 at maximum, but those for use in the present grease composition have a number average molecular weight Mn [as calculated from melting point Tm according to calculation equation Mn=200÷685(1/Tm−1/600)] of about 20,000 to about 100,000, preferably about 20,000 to about 80,000. When the number average molecular weight is outside the above-mentioned range, it will be impossible to lower the friction coefficient at the time of sliding and maintain the durability. The number average molecular weight can be controlled by adjusting an amount of a chain transfer agent to be added during the polymerization according to a suspension polymerization process, an emulsion polymerization process, a solution polymerization process, etc. or by reducing the molecular weight by radioactive ray irradiation.

The PTFE resin powders for use in the present invention also have particle sizes (primary particle sizes directly determined from an electron-microscopic picture, or average particle size when coagulation takes place too strongly to make a clear distinction as to the primary particles) of 0.3-10 μm, preferably 0.3-5 μm. When the particle size is smaller than the lower end of the range, the durability will be a problem, whereas when it is larger than the upper end of the range the particles will be hardly supplied to the lubricating surfaces, so the addition effect of PTFE resin powders cannot be attained. Commercially available PTFE resin powders having the above-mentioned ranges of molecular weight and particle sizes can be directly used as such.

The PTFE resin powders can be used in a proportion of about 1 to about 20 wt. %, preferably about 1 to about 15 wt. %, to make a 100 wt. % sum total together with the base oil, and the other additives. When the proportion of the PTFE resin powders is below the lower end of the range, the friction coefficient cannot be lowered, whereas in a proportion above the upper end of the range the durability will be hard to maintain.

The zinc dialkyldithiophosphate (ZnDTP) for use in the present invention has straight or branched alkyl groups having generally at least 3 carbon atoms, preferably 5-13 carbon atoms, and more preferably 8-12 carbon atoms. Most preferable is $C_8$—ZnDTP, whose alkyl groups are 2-ethylhexyl groups ($C_8$ branched alkyl groups) or octyl groups. When the alkyl groups each have 2 or less carbon atoms, the heat resistance will be lowered, and the extreme pressure function can be no more obtained, whereas in the case of alkyl groups each having 14 or more carbon atoms, the solubility in the base oil will be lowered. ZnDTP can be used in a proportion of not more than about 10 wt. %, preferably about 1 to about 5 wt. %, to make a 100 wt. % sum total together with the base oil and the other additives. In a proportion above 10 wt. %, an adverse effect on metals and plastics will appear.

The present grease composition can further contain other additives so far used in the conventional grease, such as an antioxidant, a rust preventive, a corrosion inhibitor, other extreme pressure agent, a viscosity index-improving agent, other solid lubricant, etc., when desired. The antioxidant includes, for example, phenolic antioxidants such as 2,6-di-t-butyl-4-methylphenol, 4,4'-methylenebis(2,6-di-t-butylphenol), etc., amine-based antioxidants such as alkyldiphenylamine, triphenylamine, phenyl-α-naphthylamine, phenothiazine, alkylated phenyl-α-naphthylamine, alkylated phenothiazine, etc., or the like. In addition, phosphorus-based antioxidants, sulfur-based antioxidants, etc. can be also used.

The rust preventive includes, for example, Ca salt, or Na salt of aromatic sulfonic acid or saturated aliphatic dicarboxylic acid, fatty acids, fatty acid amines, alkyl sulfonic acid metal salts, alkylsulfonic acid amine salts, oxidized paraffin, polyoxyalkyl ether, etc. The corrosion inhibitor includes, for example, benzotriazole, benzoimidazole, thiadiazole, etc.

Other extreme pressure agent includes, for example, phosphorus-based compounds such as phosphate esters, phosphite esters, phosphate ester amine salts, etc., sulfur-based compounds such as sulfides, disulfides, etc., sulfur-based compound metal salts such as dialkyldithiophosphoric acid metal salts (excluding zinc salts), dialkyldithiocarbamic acid metal salts, etc., chlorine-based compounds such as chlorinated paraffin, chlorinated diphenyl, etc. or the like. The extreme pressure agent can be used in such a range as not to injure the object of the present invention.

The viscosity index-improving agent includes, for example, polymethacrylate, ethylene-propylene copolymer, polyisobutylene, polyalkylstyrene, styrene-isoprene hydrogenated copolymer, etc. The other solid lubricant includes, for example, molybdenum disulfide, graphite, boron nitride, silane nitride, tungsten disulfide, fluorinated graphite, etc.

The grease composition can be prepared by mixing given amounts of the afore-mentioned components together, and thoroughly kneading the mixture through triple rolls or in a pressure homogenizer.

EXAMPLES

The present invention will be described in detail below, referring to Examples.

Examples 1-14 and Comparative Examples 1-8

Base oil A: Poly-α-olefin oil (kinematic viscosity at 40° C.: 47 $mm^2$/sec.)
Base oil B: Polyol ester oil (pentaerythritol fatty acid ester: kinematic viscosity at 40° C.: 33 $mm^2$/sec.)
Base oil C: Alkyl diphenyl ether oil (kinematic viscosity at 40° C.: 100 $mm^2$/sec.)
Thickening agent A: Li soap
Thickening agent B: Li complex soap
Thickening agent C: urea
PTFE resin powders A: Primary particle size: 0.3 μm, Mn: about 40,000
PTFE resin powders B: Average particle size: 3 μm, Mn: about 70,000
PTFE resin powders C: Average particle size: 5 μm, Mn: about 150,000
PTFE resin powders D: Average particle size: 4 μm, Mn: about 10,000
Zn-DTP A: Zinc dialkyldithiophosphate ($C_6$-branched alkyl groups)
Zn-DTP B: Zinc dialkyldithiophosphate ($C_8$-branched alkyl groups)
Zn-DTP C: Zinc dialkyldithiophosphate ($C_{12}$-straight alkyl groups)
Zn-DTP D: Zinc dialkyldithiophosphate (ethyl groups)
Mo-DTP: Molybdenum dialkyldithiophosphate ($C_8$-straight alkyl groups)
Antioxidant: Phenylnaphthylamine Grease compositions were prepared from given amounts of the afore-mentioned components to evaluate the lubricability and durability of the resulting grease compositions with a pin-on-disc type tester.

These tests were carried out by applying a given grease composition to a metallic disc, pressing a plastic pin onto the disc from the above direction, and rotating the pin, while revolving the lower disc to calculate a friction coefficient at the initial time and just before the end of the test from the frictional force generated between the pin and the disc, and determine a wear loss of the tested plastic pin to evaluate a durability.

(Test Conditions by the Pin-on-Disc Tester)

Upper test piece: Polyamide resin pin (diameter: 5 mm, and surface roughness Ra: 2 μm)

Lower test piece: S45C plate (surface roughness Ra: 2 μm)

Applied load: 2 kgf

Amount of applied grease: 0.05 g

Sliding speed: 0.8 m/sec.

Test temperature: 100° C.

Test distance: 10,000 m

Compositions of grease compositions are shown in the following Table 1, where the amount of antioxidant is 2 wt. % constant throughout and thus not given in Table 1, and the worked penetration of the grease compositions (JIS K2220 corresponding to ISO 2137), and results of determination (friction coefficient and wear loss) are shown in the following Table 2.

TABLE 2

| | Test items | | | |
|---|---|---|---|---|
| | Worked | Friction coefficient | | Wear loss |
| | penetration | Initial | Just before end | (mg) |
| Ex. 1 | 277 | 0.09 | 0.12 | 7.9 |
| Ex. 2 | 281 | 0.05 | 0.06 | 6.2 |
| Ex. 3 | 264 | 0.07 | 0.09 | 6.8 |
| Ex. 4 | 275 | 0.05 | 0.08 | 7.2 |
| Ex. 5 | 285 | 0.08 | 0.13 | 7.8 |
| Ex. 6 | 277 | 0.06 | 0.10 | 6.6 |
| Ex. 7 | 267 | 0.06 | 0.10 | 7.2 |
| Ex. 8 | 265 | 0.09 | 0.13 | 7.9 |
| Ex. 9 | 278 | 0.07 | 0.10 | 7.4 |
| Ex. 10 | 277 | 0.05 | 0.07 | 7.7 |
| Ex. 11 | 275 | 0.09 | 0.12 | 8.2 |
| Ex. 12 | 281 | 0.11 | 0.14 | 8.0 |
| Ex. 13 | 268 | 0.06 | 0.09 | 7.7 |
| Ex. 14 | 288 | 0.09 | 0.11 | 7.1 |
| Ex. 15 | 283 | 0.09 | 0.13 | 8.0 |
| Ex. 16 | 286 | 0.06 | 0.10 | 7.4 |
| Ex. 17 | 281 | 0.10 | 0.13 | 8.2 |
| Ex. 18 | 276 | 0.06 | 0.10 | 7.5 |
| Ex. 19 | 270 | 0.09 | 0.14 | 8.3 |
| Comp. Ex. 1 | 280 | 0.10 | 0.17 | 11.5 |
| Comp. Ex. 2 | 277 | 0.10 | 0.16 | 11.2 |
| Comp. Ex. 3 | 272 | 0.12 | 0.21 | 15.5 |
| Comp. Ex. 4 | 278 | 0.11 | 0.21 | 17.7 |
| Comp. Ex. 5 | 269 | 0.09 | 0.17 | 14.6 |
| Comp. Ex. 6 | 283 | 0.08 | 0.15 | 12.6 |

TABLE 1

| | Grease composition (wt. %) | | | | | | | | | | | | | | |
|---|---|---|---|---|---|---|---|---|---|---|---|---|---|---|---|
| | Base oil | | | Thickening Agent | | | PTFE powders | | | | Zn-DTP | | | | |
| Ex. | A | B | C | A | B | C | A | B | C | D | A | B | C | D | Mo-DTP |
| Ex. 1 | 62.5 | 12.0 | | | 12.5 | | 8 | | | | 3 | | | | |
| Ex. 2 | 62.5 | 12.0 | | | 12.5 | | 8 | | | | | | 3 | | |
| Ex. 3 | 62.5 | 12.0 | | | 12.5 | | 8 | | | | | 3 | | | |
| Ex. 4 | 74.5 | | | | 12.5 | | | 8 | | | | | 3 | | |
| Ex. 5 | 74.5 | | | | 12.5 | | | 8 | | | 3 | | | | |
| Ex. 6 | 63.0 | 19.5 | | 8.5 | | | 5 | | | | | | 2 | | |
| Ex. 7 | 63.0 | 19.5 | | 8.5 | | | | 5 | | | | 2 | | | |
| Ex. 8 | 63.0 | 19.5 | | 8.5 | | | 5 | | | | 2 | | | | |
| Ex. 9 | 82.5 | | | 8.5 | | | 5 | | | | | | 2 | | |
| Ex. 10 | | 20.2 | 56.3 | | 12.5 | | | 7 | | | | 2 | | | |
| Ex. 11 | | 20.2 | 56.3 | | 12.5 | | | 7 | | | 2 | | | | |
| Ex. 12 | | 20.2 | 56.3 | | 12.5 | | 7 | | | | 2 | | | | |
| Ex. 13 | | 20.2 | 56.3 | | 12.5 | | 7 | | | | | | 2 | | |
| Ex. 14 | | 26.1 | 56.2 | | | 8.7 | | 5 | | | | 2 | | | |
| Ex. 15 | | 26.1 | 56.2 | | | 8.7 | | 5 | | | 2 | | | | |
| Ex. 16 | 23.4 | 7.3 | 49.8 | 8.5 | | | | 6 | | | | 3 | | | |
| Ex. 17 | 23.4 | 7.3 | 49.8 | 8.5 | | | | 6 | | | 3 | | | | |
| Ex. 18 | 71.1 | 11.2 | | | | 8.7 | 5 | | | | | | 2 | | |
| Ex. 19 | 71.1 | 11.2 | | | | 8.7 | 5 | | | | 2 | | | | |
| Comp. Ex. 1 | 62.5 | 12.0 | | | 12.5 | | 8 | | | | | | | 3 | |
| Comp. Ex. 2 | 65.5 | 12.0 | | | 12.5 | | 8 | | | | | | | | |
| Comp. Ex. 3 | 62.5 | 12.0 | | | 12.5 | | | | | 8 | | 3 | | | |
| Comp. Ex. 4 | 86.5 | 3.0 | | 8.5 | | | | | | | | | | | |
| Comp. Ex. 5 | 81.5 | 3.0 | | 8.5 | | | | | 5 | | | | | | |
| Comp. Ex. 6 | 81.5 | 3.0 | | 8.5 | | | | 5 | | | | | | | |
| Comp. Ex. 7 | 40.2 | | 44.1 | | | 8.7 | | | | | | 5 | | | |
| Comp. Ex. 8 | 41.2 | | 38.1 | | | 8.7 | | | | 5 | | 5 | | | |
| Comp. Ex. 9 | 38.2 | | 44.1 | | | 8.7 | 5 | | | | | | | 2 | |
| Comp. Ex. 10 | 80.5 | 5.0 | | 8.5 | | | | | | 4 | | | | | |
| Comp. Ex. 11 | 63.5 | 19.0 | | 8.5 | | | | | 5 | | | | 2 | | |
| Comp. Ex. 12 | | 20.2 | 56.3 | | 12.5 | | 7 | | | | | | | 2 | |
| Comp. Ex. 13 | 71.5 | 10.0 | | 8.5 | | | | | 6 | | | | | | 2 |
| Comp. Ex. 14 | 71.5 | 10.0 | | 8.5 | | | | 6 | | | | | | | 2 |

TABLE 2-continued

| | Test items | | | |
|---|---|---|---|---|
| | Worked | Friction coefficient | | Wear loss |
| | penetration | Initial | Just before end | (mg) |
| Comp. Ex. 7 | 276 | 0.11 | 0.19 | 14.6 |
| Comp. Ex. 8 | 269 | 0.11 | 0.18 | 13.5 |
| Comp. Ex. 9 | 276 | 0.09 | 0.19 | 13.0 |
| Comp. Ex. 10 | 267 | 0.11 | 0.21 | 18.9 |
| Comp. Ex. 11 | 285 | 0.08 | 0.17 | 15.2 |
| Comp. Ex. 12 | 270 | 0.08 | 0.16 | 12.9 |
| Comp. Ex. 13 | 280 | 0.11 | 0.24 | 18.6 |
| Comp. Ex. 14 | 277 | 0.12 | 0.23 | 16.2 |

The invention claimed is:

1. A grease composition, which consists of the following components: at least one base oil selected from the group consisting of synthetic hydrocarbon oil, ester-based synthetic oil, and ether-based synthetic oil; wherein the synthetic hydrocarbon oil is at least one selected from the group consisting of poly-α-olefin oligomers, ethylene-α-olefin oligomers, polybutene, alkylbenzene, and alkylnaphthalene; the ester-based synthetic oil is at least one selected from the group consisting of monoesters, diesters, polyol esters, aromatic esters, and carbonate esters; and the ether-based synthetic oil is at least one selected from the group consisting of alkyl diphenyl ether and polypropylene glycol; 8.5-12.5% by weight of at least one thickening agent selected from the group consisting of lithium-based soap, lithium-based complex soap, and a urea-based compound; 5-8% by weight of polytetrafluoroethylene resin powders having a number average molecular weight Mn of 40,000-70,000; and 2-3% by weight of zinc dialkyldithiophosphate having straight or branched alkyl groups of 8-12 carbon atoms.

2. A grease composition according to claim 1, wherein the base oil is a mixture of the synthetic hydrocarbon oil with at least one of the ester-based synthetic oil and the ether-based synthetic oil.

3. A grease composition according to claim 1 for use in lubrication of plastic members.

4. A grease composition according to claim 3 for use in lubrication of metallic members and plastic members.

5. A grease composition according to claim 3 for application to gears or sliding parts.

6. A grease composition according to claim 5 for application to sliding parts of metallic worm gears-plastic wheel gears of electrically driven power steering.

* * * * *